US010406823B2

(12) United States Patent
Ozawa

(10) Patent No.: US 10,406,823 B2
(45) Date of Patent: Sep. 10, 2019

(54) PRINTING DEVICE, METHOD OF CONTROLLING PRINTING DEVICE, AND COMPUTER-READABLE STORAGE MEDIUM

(71) Applicant: CASIO COMPUTER CO., LTD., Shibuya-ku, Tokyo (JP)

(72) Inventor: Takeo Ozawa, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/846,933

(22) Filed: Dec. 19, 2017

(65) Prior Publication Data

US 2018/0178548 A1 Jun. 28, 2018

(30) Foreign Application Priority Data

Dec. 26, 2016 (JP) ..... 2016-250855

(51) Int. Cl.
*B41J 2/355* (2006.01)
*B41J 13/03* (2006.01)
*B41J 3/407* (2006.01)

(52) U.S. Cl.
CPC ..... *B41J 2/355* (2013.01); *B41J 2/3551* (2013.01); *B41J 2/3555* (2013.01); *B41J 3/4075* (2013.01); *B41J 13/03* (2013.01)

(58) Field of Classification Search
CPC ..... B41J 2/355; B41J 2/3551; B41J 2/3555; B41J 3/4075; B41J 13/03
See application file for complete search history.

(56) References Cited

U.S. PATENT DOCUMENTS 5,442,381 A * 8/1995 Fukubeppu ..... B41J 2/37 347/182
5,511,890 A * 4/1996 Momose ..... B41J 19/142 400/279

(Continued)

FOREIGN PATENT DOCUMENTS

JP 07323597 A 12/1995

*Primary Examiner* — Justin Seo
(74) *Attorney, Agent, or Firm* — Holtz, Holtz & Volek PC

(57) ABSTRACT

A printing device comprises: a print head configured to print a plurality of print lines on a medium to be printed, the medium being conveyed in a conveying direction; and a processor configured to control the print head. The processor is configured to: control the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, the second print line being adjacent to the first print line along the conveying direction, control the print head to perform, after printing the first print line before printing the second print line, complementary printing that complements missing print estimated to occur between the first print line and the second print line in a case where a number of the printing times in the first print line and a number of the printing times in the second print line are set to different values from each other, and a number of the printing times is set to two or more.

18 Claims, 14 Drawing Sheets

(56) References Cited

U.S. PATENT DOCUMENTS

2006/0221110 A1* 10/2006 Kusakari ..... B41J 25/001
347/15
2012/0250040 A1* 10/2012 Yamazaki ..... B41J 2/2135
358/1.8

* cited by examiner

PRINTING DEVICE, METHOD OF CONTROLLING PRINTING DEVICE, AND COMPUTER-READABLE STORAGE MEDIUM

CROSS-REFERENCE TO RELATED APPLICATIONS

The entire contents of JP Patent Application No. 2016-250855, filed on Dec. 26, 2016 are incorporated in the present specification by reference.

BACKGROUND OF THE INVENTION

1. Field of the Invention

The present invention relates to a printing device, a method of controlling a printing device, and a computer-readable storage medium.

2. Description of the Related Art

Conventionally, there are known printing devices that control energization of a plurality of heat generating elements provided in a thermal head while conveying a medium to be printed by a motor, to print one print line at a time on the medium to be printed.

A technology to increase a printing speed as much as possible without increasing a current capacity of a power adapter in such printing devices is described in JP 07-323597 A, for example. The literature discloses a technology of variable division printing in which the number of heat generating elements (hereinafter, described as the number of dots) to be energized is counted for each print line, and each print line is printed by printing of the number of printing times determined for each print line by time division.

By the way, switching of excitation of the motor a plurality of times per print line in the printing device is desirable to increase the printing speed.

However, if switching of excitation is performed a plurality of times per print line in the printing device, which employs the variable division printing, the switching of excitation may be performed in between printing of a plurality of times by time division to print one print line.

For example, in a case where a certain print line is printed by the number of printing of 2 times by time division, if the switching of excitation is performed between print dots of portion printed in the first half and print dots of portion printed in the second half, of print dots of the print line, print positions of the print dots of both are different from each other along a conveying direction.

Due to such variation of the print positions of the print dots along the conveying direction, a distance of the conveying direction between the print dots of two print lines adjacent to each other along the conveying direction varies. As a result, missing print may occur due to a slight gap caused in a part of an area that is supposed to be painted out by the printing.

BRIEF SUMMARY OF THE INVENTION

According to a present embodiment, occurrence of missing print can be suppressed in a configuration of performing variable division printing.

In order to obtain the above advantages, a printing device of a present invention, comprises: a print head configured to print a plurality of print lines on a medium to be printed, wherein the medium is conveyed in a conveying direction; and a processor configured to control the print head, wherein the processor is configured to: control the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, wherein the second print line is adjacent to the first print line along the conveying direction, control the print head to perform, after printing the first print line before printing the second print line, complementary printing that complements missing print estimated to occur between the first print line and the second print line in a case where a number of the printing times in the first print line and the number of the printing times in the second print line are set to different values from each other and a number of the printing times in the second print line is set to two or more.

In order to obtain the above advantages, in a method of controlling a printing device in a present invention, the printing device comprises a print head configured to print a plurality of print lines on a medium to be printed, the medium being conveyed in a conveying direction, and the method comprises: controlling the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, wherein the second print line is adjacent to the first print line along the conveying direction, controlling the print head to perform, after printing the first print line before printing the second print line, complementary printing that complements missing print estimated to occur between the first print line and the second print line in a case where a number of printing times in the first print line and a number of printing times in the second print line are set to different values from each other, and a number of the printing times in the second line is set to two or more.

In order to obtain the above advantages, in a computer-readable storage medium in which a control program of a printing device is stored, the printing device comprises a print head configured to print a plurality of print lines on a medium to be printed, the medium being conveyed in a conveying direction, and the control program causes the printing device to: control the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, the second print line being adjacent to the first print line along the conveying direction, control the print head to perform, after printing the first print line before printing the second print line, complementary printing that complements missing print estimated to occur between the first print line and the second print line in a case where a number of the printing times in the first print line and a number of the printing times in the second print line are set to different values from each other, and a number of the printing times in the second printing line is set to two or more.

DETAILED DESCRIPTION OF THE INVENTION

A printing device according to an embodiment of the present invention will be described in details with reference to the figures.

Figure 1:
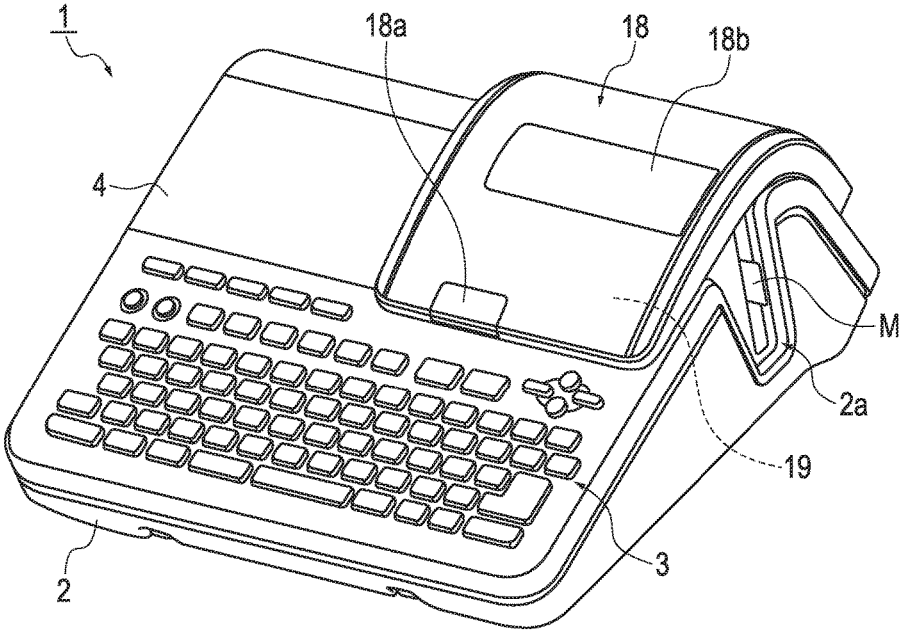
FIG. 1 is a perspective view of a printing device 1.

FIG. 1 is a perspective view of a printing device 1 according to an embodiment of the present disclosure.

The printing device 1 is a printing device including a thermal head that performs printing on a medium to be printed, and is, for example, a label printer that performs printing on a long medium to be printed M in a single pass method.

Hereinafter, a thermal transfer-type label printer using an ink ribbon as the printing device will be described as an example. However, a printing method is not particularly limited.

The medium to be printed M is, for example, a tape member including a base material including an adhesive layer and a release paper releasably stuck to the base material to cover the adhesive layer. Note that the medium to be printed M may be a tape member without the release paper.

As illustrated in FIG. 1, the printing device 1 includes a device housing 2, an input unit 3, a display unit 4, an opening/closing cover 18, and a cassette accommodation unit 19.

The input unit 3, the display unit 4, and the opening/closing cover 18 are arranged on an upper surface of the device housing 2.

Although not illustrated, the device housing 2 is provided with a power cord connecting terminal, an external device connecting terminal, a storage medium inserting opening, and the like.

The input unit 3 includes various keys such as an input key, a cross key, a conversion key, and enter key.

The display unit 4 is, for example, a liquid crystal display panel, and displays characters corresponding to inputs from the input unit 3, selection menus for various types of setting, messages related to various types of processing, and the like. During printing, contents such as letters, figures and the like instructed to be printed on the medium to be printed M may be displayed, and progress of print processing may be displayed.

Note that a touch panel unit may be provided on the display unit 4, and in that case, the display unit 4 may be regarded as a part of the input unit 3.

The opening/closing cover 18 is arranged on an upper portion of the cassette accommodation unit 19 in an openable and closable manner.

The opening/closing cover 18 is opened when a button 18*a* is pressed. A window 18*b* is formed in the opening/closing cover 18, which enables visual confirmation as to whether a tape cassette 30 (see FIG. 2) is accommodated in the cassette accommodation unit 19 even in a state where the opening/closing cover 18 is closed.

A discharge port 2*a* is formed in a side surface of the device housing 2. The medium to be printed M on which printing has been performed in the printing device 1 is discharged through the discharge port 2*a* to an outside of the device.

Figure 2:
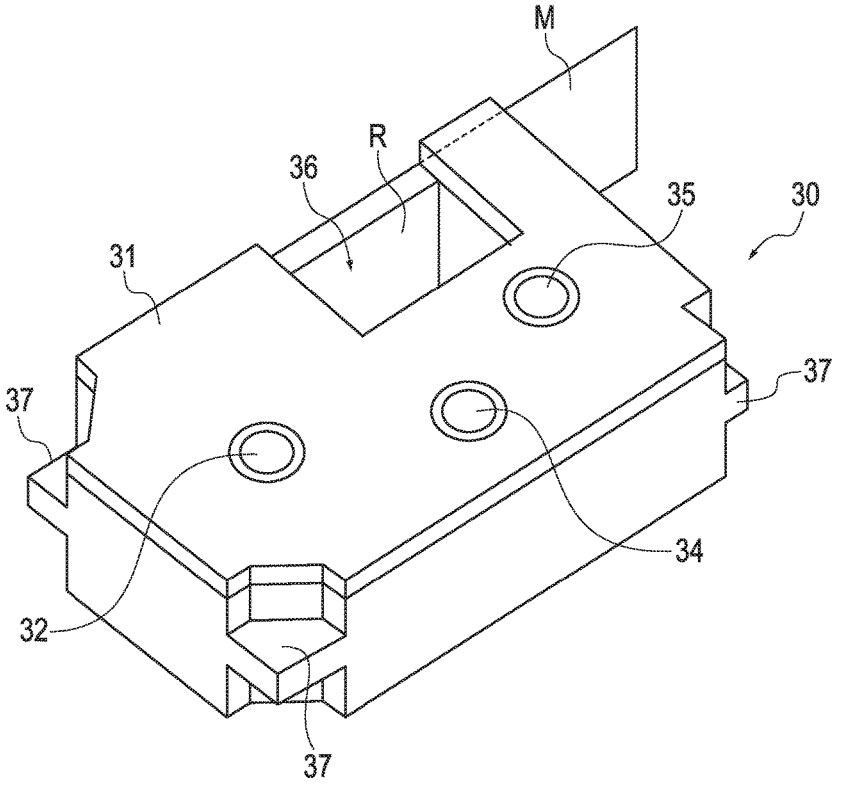
FIG. 2 is a perspective view of a tape cassette 30 accommodated in the printing device 1.

FIG. 2 is a perspective view of the tape cassette 30 accommodated in the printing device 1.

Figure 3:
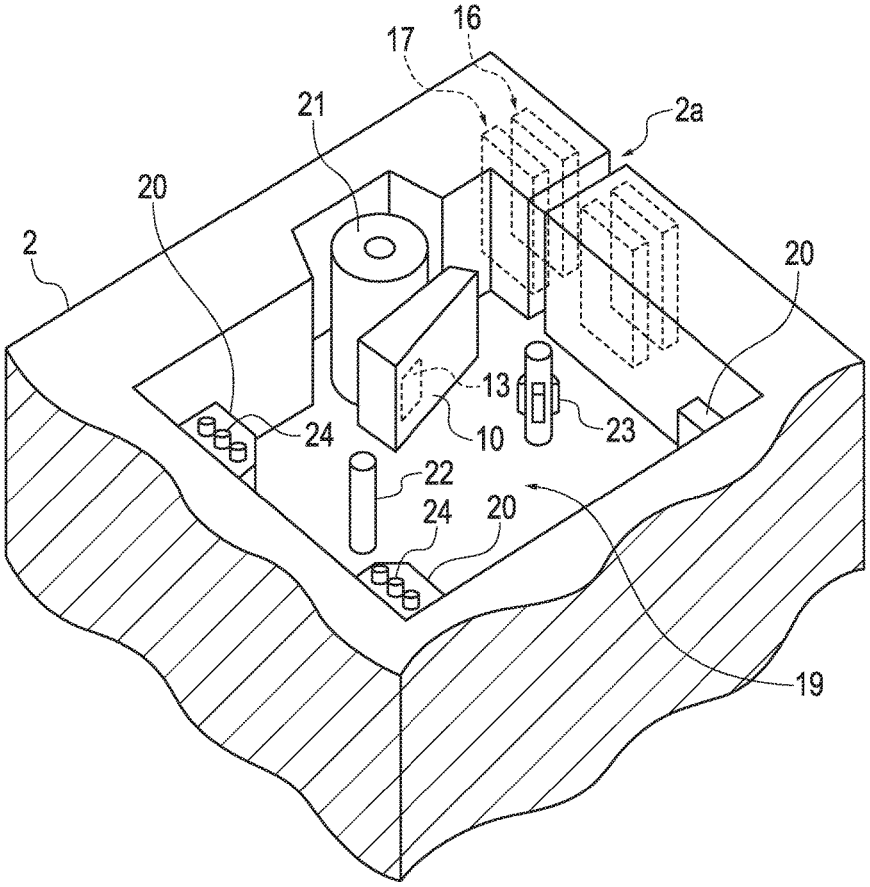
FIG. 3 is a perspective view of a cassette accommodation unit 19 of the printing device 1.

FIG. 3 is a perspective view of the cassette accommodation unit 19 of the printing device 1.

Figure 4:
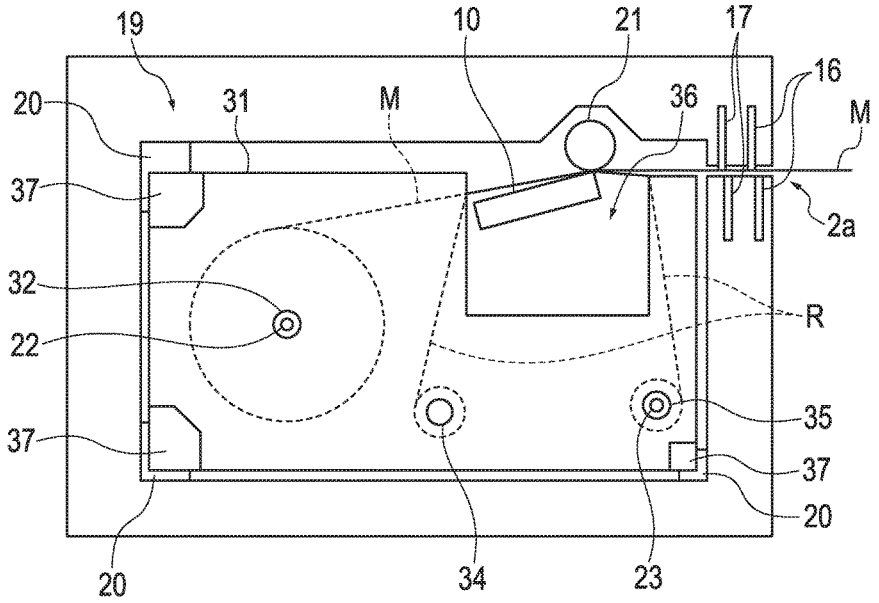
FIG. 4 is a sectional view of the printing device 1.

FIG. 4 is a sectional view of the printing device 1.

The tape cassette 30 illustrated in FIG. 2 is detachably accommodated in the cassette accommodation unit 19 illustrated in FIG. 3.

FIG. 4 illustrates a state in which the tape cassette 30 is accommodated in the cassette accommodation unit 19.

As illustrated in FIG. 2, the tape cassette 30 includes a cassette case 31 in which a thermal head inserting portion 36 and an engaging portion 37 are formed, and which accommodates the medium to be printed M and an ink ribbon R.

The cassette case 31 is provided with a tape core 32, an ink ribbon supply core 34, and an ink ribbon take-up core 35.

The medium to be printed M is wound in a roll manner on the tape core 32 inside the cassette case 31.

The ink ribbon R for thermal transfer is wound in a roll manner on the ink ribbon supply core 34 inside the cassette case 31 in a state where a tip of the ink ribbon R is wound around the ink ribbon take-up core 35.

As illustrated in FIG. 3, a plurality of cassette receiving portions 20 for supporting the tape cassette 30 at a predetermined position are provided in the cassette accommodation unit 19 of the device housing 2.

The cassette receiving portion 20 is provided with a tape width detection switch 24 for detecting the width of the tape (medium to be printed M) accommodated in the tape cassette 30.

The tape width detection switch 24 is a detection unit that detects the width of the medium to be printed M on the basis of the shape of the cassette.

The cassette accommodation unit 19 further includes a thermal head 10 as a print head that includes a plurality of heat generating elements and performs printing on the medium to be printed M, a platen roller 21 as a conveyance unit that conveys the medium to be printed M, a tape core engaging shaft 22, and an ink ribbon take-up drive shaft 23. A thermistor 13 is buried in the thermal head 10. The thermistor 13 is a measuring unit that measures the temperature of the thermal head 10.

In a state where the tape cassette 30 is accommodated in the cassette accommodation unit 19, as illustrated in FIG. 4, the engaging portion 37 provided in the cassette case 31 is supported by the cassette receiving portion 20 provided in the cassette accommodation unit 19, and the thermal head 10 is inserted into the thermal head inserting portion 36 formed in the cassette case 31.

The tape core 32 of the tape cassette 30 is engaged with the tape core engaging shaft 22, and the ink ribbon take-up core 35 is engaged with the ink ribbon take-up drive shaft 23.

When a print instruction is input to the printing device 1, the medium to be printed M is sent out from the tape core 32 by rotation of the platen roller 21. At this time, the ink ribbon take-up drive shaft 23 is rotate in synchronization with the platen roller 21. Therefore, the ink ribbon R is sent out from the ink ribbon supply core 34 together with the medium to be printed M. With the operation, the medium to be printed M and the ink ribbon R are conveyed in an overlapped state.

When the ink ribbon R passes through between the thermal head 10 and the platen roller 21, the ink ribbon R is heated by the thermal head 10, whereby the ink is transferred to the medium to be printed M, and printing of an image based on print data is performed.

The used ink ribbon R that has passed through between the thermal head 10 and the platen roller 21 is taken up by the ink ribbon take-up core 35.

Meanwhile, the printed medium to be printed M that has passed through between the thermal head 10 and the platen roller 21 is cut by a half-cut mechanism 16 and a full-cut mechanism 17 and is discharged through the discharge port 2*a*.

Figure 5:
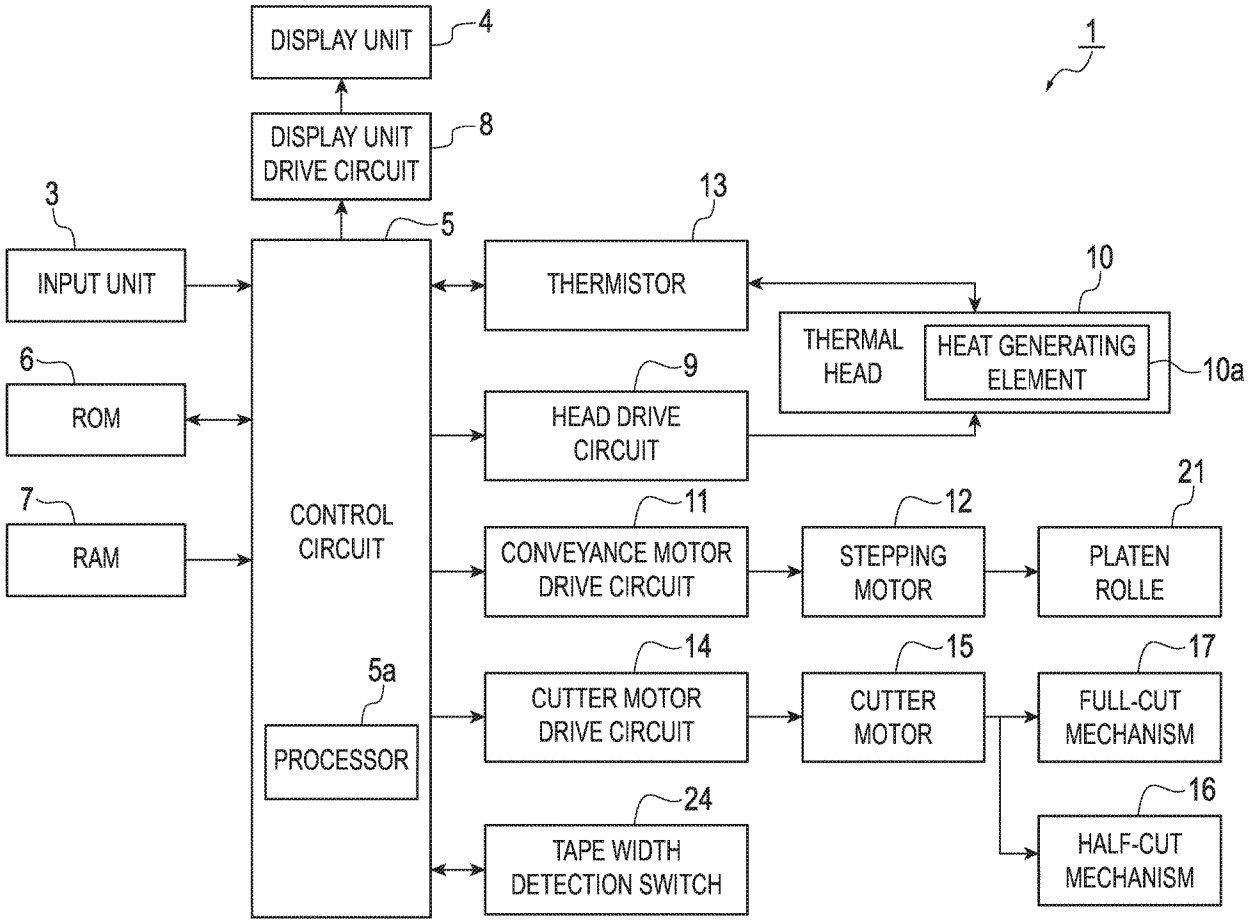
FIG. 5 is a control block diagram of the printing device 1.

FIG. 5 is a control block diagram of the printing device 1. The printing device 1 further includes a control circuit 5, a read only memory (ROM) 6, a random access memory (RAM) 7, a display unit drive circuit 8, a head drive circuit 9, a conveyance motor drive circuit 11, a stepping motor 12, a cutter motor drive circuit 14, and a cutter motor 15, in addition to the input unit 3, the display unit 4, the thermal head 10, the thermistor 13, the half-cut mechanism 16, the full-cut mechanism 17, the platen roller 21, and the tape width detection switch 24.

Note that the control circuit 5, the ROM 6, and the RAM 7 configure a computer of the printing device 1.

The control circuit 5 includes a processor 5*a* such as a central processing unit (CPU). The control circuit 5 expands a program stored in the ROM 6 into the RAM 7 and executes the program to control operations of the units of the printing device 1.

The control circuit 5 is a head control unit that controls the thermal head 10 via the head drive circuit 9, for example, and generates a strobe signal and print data and supplies them to the head drive circuit 9. The control circuit 5 is further a conveyance control unit that controls the platen roller 21 and is a cut control unit that controls the cutting mechanisms.

The ROM 6 stores a print program for performing printing on the medium to be printed M, and various data (for example, a font etc.) necessary for executing the print program. The ROM 6 also functions as a storage medium in which a program readable by the control circuit 5 is stored.

The RAM 7 functions as an input data memory for storing various types of information about printing (hereinafter referred to as print information). The RAM 7 also functions as a print data memory for storing data (hereinafter referred to as print data) indicating a pattern of print details to be formed on the medium to be printed, which is generated on the basis of the print information. Further, the RAM 7 also functions as a display data memory for storing display data generated on the basis of the print information.

The display unit drive circuit 8 controls the display unit 4 on the basis of the display data stored in the RAM 7.

The display unit 4 may display the print details in a manner that progress of print processing can be recognized under control of the display unit drive circuit 8, for example.

The head drive circuit 9 performs energization or deenergization of a plurality of heat generating elements 10*a* on the basis of the strobe signal and the print data. To be specific, the head drive circuit 9 performs energization or deenergization of the plurality of heat generating elements 10*a* on the basis of the print data during a period in which the strobe signal (control signal) is ON (hereinafter, the period is referred to as energization control period).

The thermal head 10 is a print head including the plurality of heat generating elements 10*a* arrayed in a main scanning direction.

The thermal head 10 heats the ink ribbon R with the heat generating element 10*a* to perform printing on the medium to be printed M by thermal transfer, when the heat generating elements 10*a* is selectively energized by the head drive circuit 9 according to the print data during the energization control period of the strobe signal supplied from the control circuit 5.

The conveyance motor drive circuit 11 drives the stepping motor 12. The stepping motor 12 drives the platen roller 21.

The platen roller 21 is rotated by power of the stepping motor 12, and conveys the medium to be printed M in a longitudinal direction (a sub-scanning direction or the conveying direction) of the medium to be printed M.

That is, the stepping motor 12 is a conveyance motor for conveying the medium to be printed M in the conveying direction, and a conveying unit for conveying the medium to be printed M in the conveying direction includes the stepping motor 12.

The cutter motor drive circuit 14 drives the cutter motor 15.

The half-cut mechanism 16 and the full-cut mechanism 17 are driven by power of the cutter motor 15 to half-cut or full-cut the medium to be printed M.

The full cut is an operation to cut the base material of the medium to be printed M along the width direction together with the release paper and the half cutting is an operation to cut only the base material along the width direction.

In the printing device 1 configured as described above, an image based on the print data printed on the medium to be printed M by the thermal head 10 is configured from a plurality of print lines extending in a direction orthogonal to the conveying direction and adjacent to each other along the conveying direction.

That is, the thermal head 10 is configured to print the plurality of printing lines on the medium to be printed M.

In printing of one print line, there is a possibility of a shortage of the current capacity of the power adapter that supplies a current to the thermal head 10 when the thermal head 10 tries to perform energization at once for the plurality of heat generating elements 10*a* included in the thermal head 10.

Therefore, the printing device 1 divides one print line into a plurality of lines and performs printing of one print line by printing of a plurality of times by time division (division printing) when the number of the heat generating elements 10*a* to be energized according to the print data exceeds a predetermined number, in the printing of one print line.

That is, the control circuit 5 controls the thermal head 10 to print the print line by time division by a number of the printing times according to the number of print dots that configures the print line. In other words, the control circuit 5 controls the thermal head 10 to perform the division printing of each of the print lines by time division by a number of a printing times set according to the print data. In still other words, when the number of the printing times is two or more, the control circuit 5 divides the corresponding print line by the number of divisions according to the number of the printing times, and performs the division printing by time division.

Note that the print line refers to a line to be printed on the medium to be printed M.

The print dot refers to each of a plurality of dots that configures the print line, and one print dot corresponds to one heat generating element to be energized.

A case of printing the print line at once (the case is described as batch printing) and a case of dividing printing into a plurality of times by time division and performing printing (the case is described as division printing) differs in necessary time for printing. The batch printing requires a shorter time to print the one print line. Therefore, the printing device 1 is configured to have the medium to be printed conveyed at a higher speed at the batch printing than at the division printing. To be more specific, the printing device 1 is configured to have the medium to be printed M conveyed at different conveying speeds when the number of the printing times is different.

The printing device 1 is configured such that the medium to be printed M is conveyed by the stepping motor 12 performing rotation operation due to the control circuit 5 performing switching of excitation of the stepping motor 12 via the conveyance motor drive circuit 11.

In a case where the switching of excitation is performed a plurality of times per line, the conveyance amount of the medium to be printed M per unit time increases as compared with the case where the switching of excitation is performed once, and the conveying speed is increased.

According to the printing device 1, the variable division printing to change the number of the printing times by time division is performed on the basis of the print data. Therefore, the printing speed can be increased as much as possible without increasing the current capacity of the power adapter.

Further, the printing device 1 performs complementary printing for suppressing occurrence of missing print.

The complementary printing is printing performed between two print lines adjacent to each other along the conveying direction to suppress occurrence of missing print. Therefore, the occurrence of missing print can be suppressed while speeding up by the variable division printing is realized.

Figure 6:
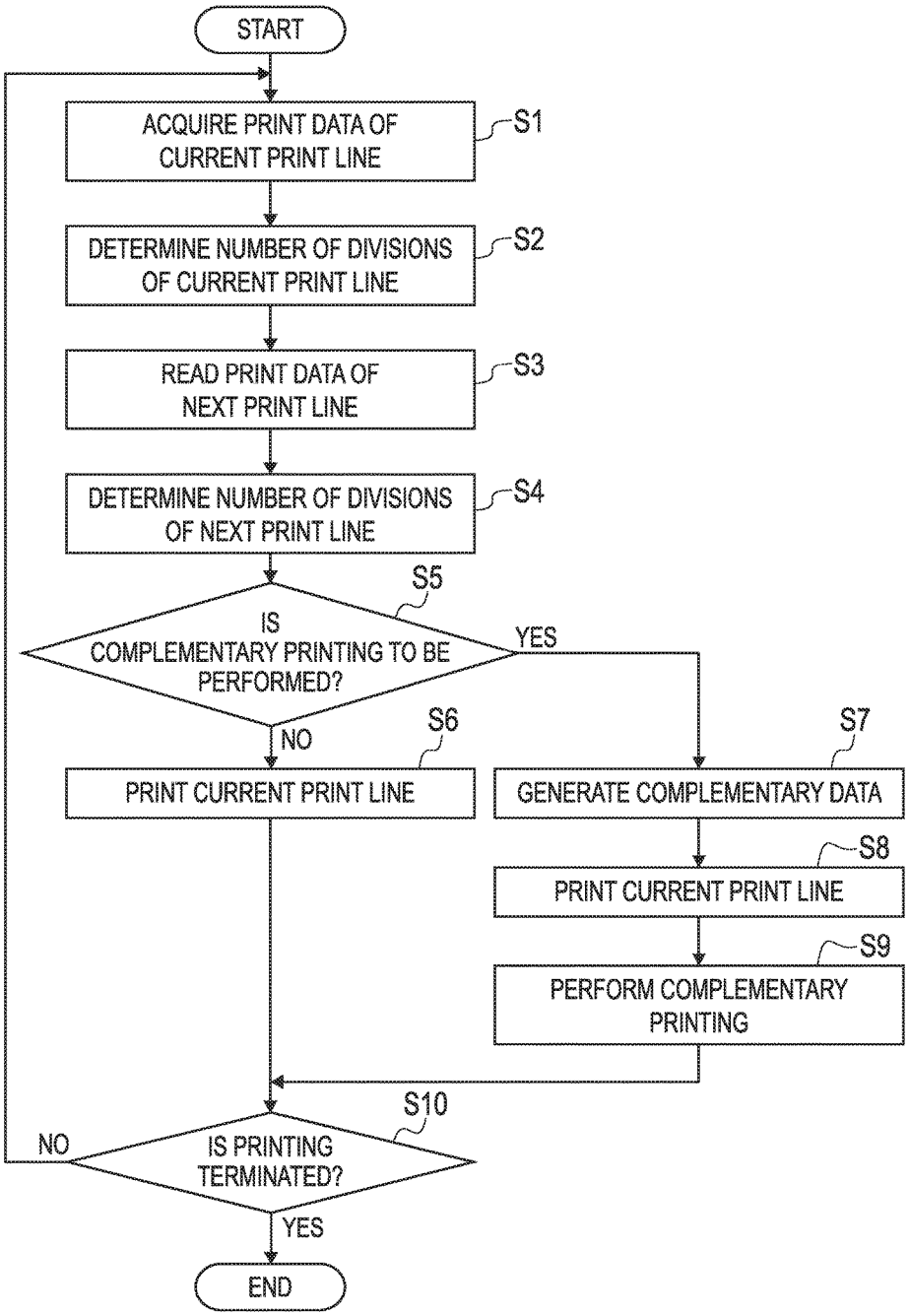
FIG. 6 is a flowchart of print control processing performed by a control circuit 5 of the printing device 1.

FIG. 6 is a flowchart of print control processing performed by the control circuit 5 of the printing device 1.

Hereinafter, the print control processing performed by the control circuit 5 will be specifically described with reference to FIG. 6.

In the printing device 1, when start of the print processing is instructed from the input unit 3, the control circuit 5 executes a print program to perform the print control processing illustrated in FIG. 6.

First, the control circuit 5 acquires print data of a print line to be printed this time (hereinafter, referred to as current print line) (step S1). The control circuit 5 further determines the number of the printing times by time division of the current print line (step S2).

That is, in step S2, the control circuit 5 determines the number of the printing times by time division in division printing of the current print line on the basis of the print data acquired in step S1.

When the number of the printing times is two or more, the control circuit 5 generates print data for division printing on the basis of the print data acquired in step S1.

The method of determining the number of printing times is not particularly limited.

For example, the control circuit 5 determines whether the current print line includes the number of the print dots, the number exceeding a predetermined number, on the basis of the print data. The control circuit 5 may determine the number of printing times by time division in division printing to be 2 when determining that the number exceeds the predetermined number. The control circuit 5 may determine the number of the printing times to be 1, that is, may determine that the division is not performed, when determining that the number is the predetermined number or less.

Next, the control circuit 5 acquires print data of a print line be printed next time (hereinafter, referred to as next print line) (step S3).

Next, the control circuit 5 further determines the number of the printing times of the next print line (step S4).

That is, in step S4, the control circuit 5 determines the number of the printing times by time division of the next print line on the basis of the print data acquired in step S3. Note that the method of determining the number of the printing times is similar to that in step S2.

After that, the control circuit 5 determines whether to perform the complementary printing on the basis of the print data of the current print line and the print data of the next print line (step S5).

Here, whether to perform the complementary printing may be determined on the basis of whether missing print may occur between the current print line and the next print line, and the control circuit 5 may determine to perform the complementary printing when the missing print may occur.

The control circuit 5 may determine that the missing print may occur when the numbers of the printing times by time division of each of the current print line (also referred to as first print line) and the next print line (also referred to as second print line) adjacent to each other along the conveying direction are different from each other.

Here, in a case where the numbers of the printing times of each printing line are different from each other, a distance along the conveying direction between the print dots of the two print lines adjacent to each other along the conveying direction may be different as compared with a case where a case where the numbers of the printing times of each print line are the same with each other. As a result, the missing print due to a gap caused in a part of the print dots of the two print lines adjacent to each other along the conveying direction may occur. Therefore, the control circuit 5 may determine that the missing print may occur when the numbers of the printing times by time division of the first print line and the second print line are different from each other.

The control circuit 5 may determine that the missing print may occur when the numbers of the printing times by time division of the current print line and the next print line adjacent to each other along the conveying direction are different from each other, and the number of the printing times of the next print line is not one (that is, plural).

When the number of the printing times of the next print line is one, that is, in a case of no division, the distance between two print dots adjacent to each other along the conveying direction is changed within a range of a reference distance or less. Here, the reference distance is a distance along the conveying direction between print dots printed in the first printing of each printing line.

A gap is usually less likely to occur between print dots printed at intervals of the reference distance, and thus the missing print is less likely to occur.

Therefore, even when the numbers of the printing times of the current print line and the next print line are different from each other, it may be determined that the missing print may not occur when the number of the printing times of the next print line is one. With the determination, wasteful complementary printing can be suppressed.

For example, the control circuit 5 may determine that the missing print may occur when the numbers of the printing times by time division of the current print line and the next print line adjacent to each other along the conveying direction are different from each other, and the printing of the next print line spans timing before and after switching of excitation of the stepping motor 12.

Note that performing the printing of the next print line spanning timing before and after switching of excitation refers to performing printing at both timing before and after switching of excitation of the next print line.

That is, performing the printing of the next print line spanning timing before and after switching of excitation may be any of (1) a case where the first printing is performed before the switching of excitation and the second printing is performed after the switching of excitation, (2) a case where the first printing and a part of the second printing are performed before the switching of excitation and the remaining part of the second printing is performed after the switching of excitation, and (3) a case where a part of the first printing is performed before the switching of excitation and the remaining part of the first printing and the second printing are performed after the switching of excitation.

Even if the number of the printing times by time division of the next print line is a plurality of times, if the printing of the plurality of times is not performed to span the timing before and after the switching of excitation, it can be considered that the distance between the print dots adjacent to each other along the conveying direction is changed within the range of the reference distance or less, similarly to the case where the number of the printing times of the next print line is one.

Therefore, even when the numbers of the printing times by time division of the current print line and the next print time are different from each other, it may be determined that the missing print may not occur when the printing of the next print line is not performed to span timing before and after the switching of excitation. With the determination, wasteful complementary printing can be further suppressed.

Further, the control circuit 5 may determine that the missing print may occur when the numbers of the printing times of the current print line and the next print line adjacent to each other along the conveying direction are different from each other, and the last printing, of the printing of the next print line, is performed after the switching of excitation.

When the control circuit 5 determines not to perform the complementary printing in step S5, the control circuit 5 prints the current print line (step S6). Here, the control circuit 5 controls the thermal head 10 to perform printing on the basis of the print data acquired in step S1. Specifically, in a case where the number of the printing times determined in step S2 is one, the control circuit 5 supplies the print data acquired in step S1 to the head drive circuit 9 to cause the thermal head 10 to perform printing. In a case where the number of the printing times determined in step S2 is not one, the control circuit 5 supplies the print data for division printing generated in step S2 to the head drive circuit 9 to cause the thermal head 10 to perform division printing by time division.

When the control circuit 5 determines to perform the complementary printing in step S5, the control circuit 5 generates complementary data (step S7).

Here, the control circuit 5 generates the complementary data from the print data of the current print line and the print data of the next print line.

Specifically, the control circuit 5 may generate the complementary data on the basis of the print dots adjacent to each other along the conveying direction, more specifically, according to a logical product of the print data of the print lines adjacent to each other along the conveying direction.

This is because the missing print occurs between two print dots adjacent to each other along the conveying direction and cannot occur when there are no adjacent print dots with each other along the conveying direction. As a result, the complementary data can be generated with simple operation.

Further, the control circuit 5 may generate the complementary data from print data that is prone to cause the missing print, of the print data, of two print lines adjacent to each other along the conveying direction.

Figure 8B:
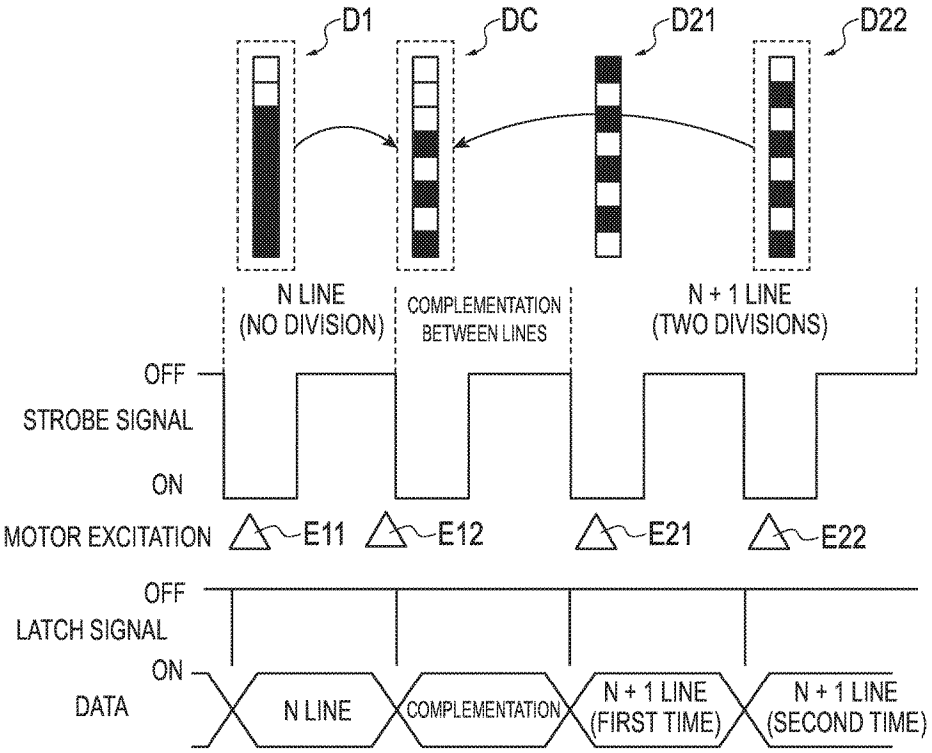
FIGS. 8A and 8B are diagrams illustrating an example in which complementary printing is performed when the number of the printing times is changed from one to two.

For example, as illustrated in FIG. 8B, the control circuit 5 may generate complementary data DC from print data D1 of the current print line (an N line and the number of the printing times=1), and print data D22 corresponding to the printing performed after switching of excitation E22, of print data (D21 and D22) of the next print line (an N+1 line and the number of the printing times=2).

This is because the printing performed after the switching of excitation E22, of the printing of the next printing line (N+1 line), is performed at a position more distant from the current print line (N line) along the conveying direction and is thus prone to cause the missing print than the printing performed before the switching of excitation E22.

In this case as well, the control circuit 5 may generate the complementary data DC on the basis of two print dots adjacent to each other along the conveying direction, that is, according to the logical product of the print data of two print lines adjacent to each other along the conveying direction. As a result, the complementary data can be generated with simple operation.

FIG. 8B illustrates an example in which the complementary data DC (00010101) is generated according to a logical product of the print data D1 (00111111) and the print data D22 (01010101).

When the complementary data is generated, the control circuit 5 firstly causes the current print line to be printed (step S8). Thereafter, the control circuit 5 causes the complementary printing to be performed on the basis of the complementary data generated in step S7 (step S9).

That is, after the printing of the current print line and before the printing of the next print line, the control circuit 5 controls the thermal head 10 to perform the complementary printing based on the complementary data generated in step S7 from the print data of the current print line and the print data of the next print line. Note that the processing in step S8 is similar to the processing in step S6.

When the processing of step S6 or step S9 is completed, the control circuit 5 determines whether the print processing has been terminated, that is, whether the printing of the last line has been terminated (step S10).

Then, by repetition of the processing from step S1 to step S10 until the completion of the printing of the last line is determined in step S10, the print control processing illustrated in FIG. 6 is completed.

Figure 7B:
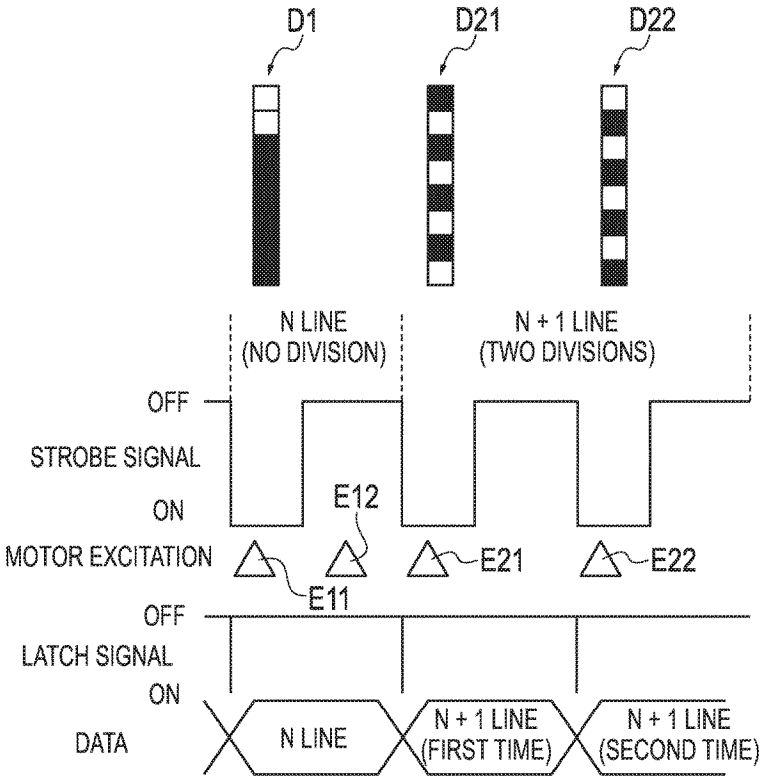
FIGS. 7A and 7B are diagrams illustrating an example in which complementary printing is not performed when the number of the printing times is changed from one to two.
Figure 7A:
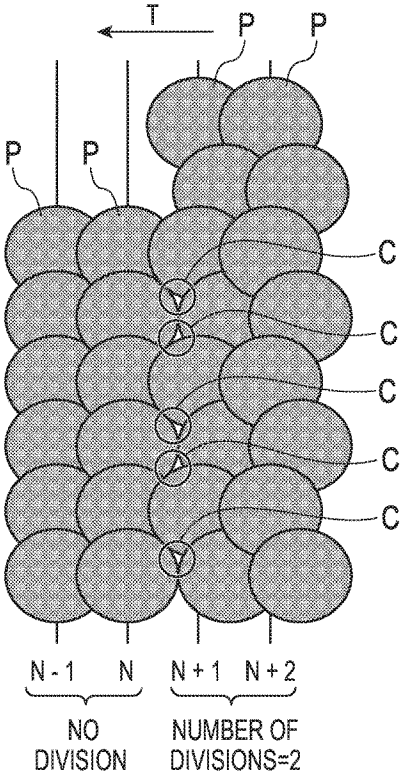

FIGS. 7A and 7B are diagrams illustrating an example in which complementary printing is not performed when the number of the printing times is changed from one to two.

Figure 8A:
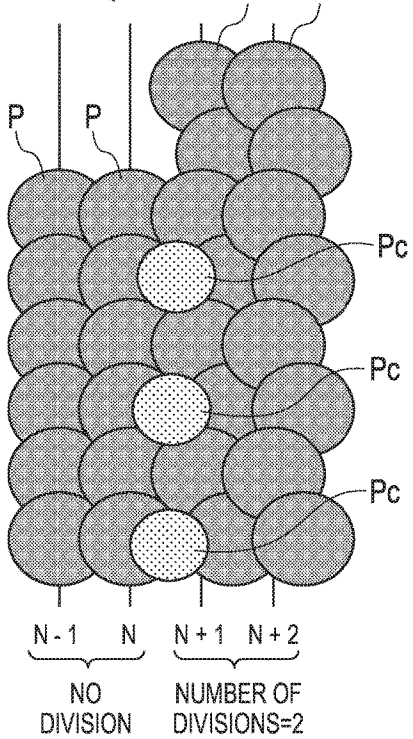

FIGS. 8A and 8B are diagrams illustrating an example in which complementary printing is performed when the number of the printing times is changed from one to two.

FIG. 7A illustrates an example of a print state of when no complementary printing is performed and FIG. 8A illustrates an example of a print state of when the complementary printing is performed.

FIG. 7B illustrates an example of a timing chart of when no complementary printing is performed and FIG. 8B illustrates an example of a timing chart of when the complementary printing is performed.

Note that print dots P illustrated in FIGS. 7A and 8A are images of print dots printed by normal printing, a print dot (second print dot) Pc illustrated in FIG. 8A is an image of a print dot printed by the complementary printing, and arrows T illustrated in FIGS. 7A and 8A indicate the conveying direction of the medium to be printed M.

A gap C caused in a part between the print dots P illustrated in FIG. 7A is the missing print.

The print data D1, D21, and D22 illustrated in FIGS. 7B and 8B are the print data of the N line, the print data of the first printing (first half) of the N+1 line, and the print data of the second printing (second half) of the N+1 line, respectively.

The print data DC illustrated in FIG. 8B indicates the complementary data.

The switching of excitation E11, E12, E21, and E22 illustrated in FIGS. 7B and 8B indicate timing when the first switching of excitation of the N line is performed, timing when the second switching of excitation of the N line is performed, timing when the first switching of excitation of the N+1 line is performed, and timing when the second switching of excitation of the N+1 line are performed, respectively.

Even if the gap C is caused between the print dots of the lines (here, the N line and the N+1 line) having the different numbers of the printing times, as illustrated in FIG. 7A, due to the print control processing illustrated in FIG. 6 performed in the printing device 1, in the conventional printing in which the complementary printing is not performed, the complementary printing based on the complementary data is performed at the position where the gap C is caused, as illustrated in FIG. 8A, after the printing of the N line and before the printing of the N+1 line, as illustrated in FIG. 8B, and the print dot Pc is printed. Therefore, printing in which occurrence of the missing print is suppressed can be performed.

That is, the complementary data is set to form the print dot at the position corresponding to the gap C caused between the print dot formed on the medium to be printed M by the printing of the N line and the print dot formed on the medium to be printed M by the printing of the N+1 print line, by the complementary printing.

Therefore, according to the printing device 1, occurrence of the missing print can be suppressed while speeding up by the variable division printing is realized.

Note that FIGS. 8A and 8B illustrate the example of the case where the energization control period of the complementary printing is the same as the energization control period of the printing of each line. However, the energization control period of the complementary printing may be shorter period than the energization control period of the printing of each line.

That is, a size of the print dots Pc may be somewhat smaller than a size of the print dots P because, it suffices if the gap C caused when the complementary printing is not performed between the print dots P is blocked by the print dots Pc, in the complementary printing. Therefore, the energization control period of the complementary printing is, for example, about 80 to 90% of the energization control period of the printing of each line.

Further, by making the energization control period of the complementary printing short within the range where the gap C is blocked, the density of the portion where the complementary printing is performed becoming too thicker than print density planned by the print data can be suppressed.

Figure 9:
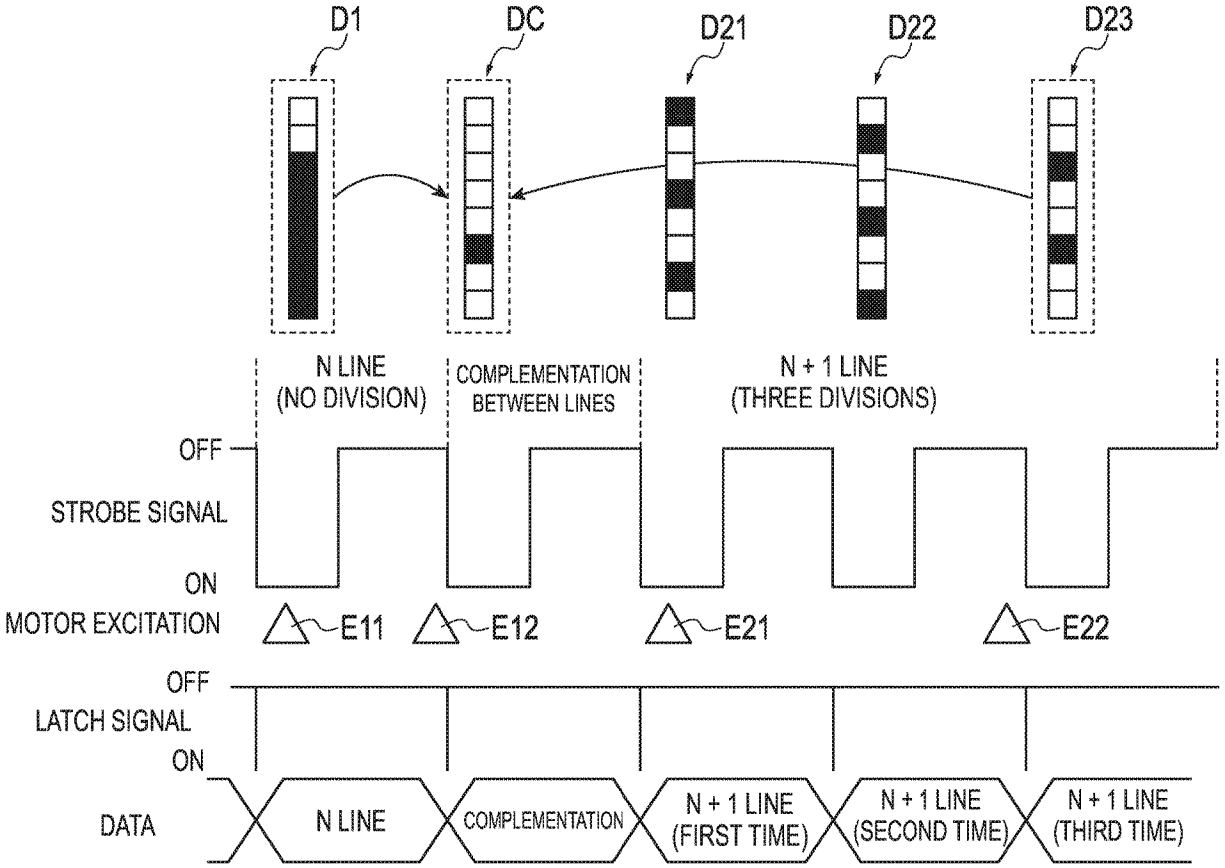
FIG. 9 is a diagram illustrating an example of a timing chart of when the number of the printing times is changed from one to three.

FIG. 9 is a diagram illustrating an example of a timing chart of when the number of the printing times is changed from one to three.

Figure 10A:
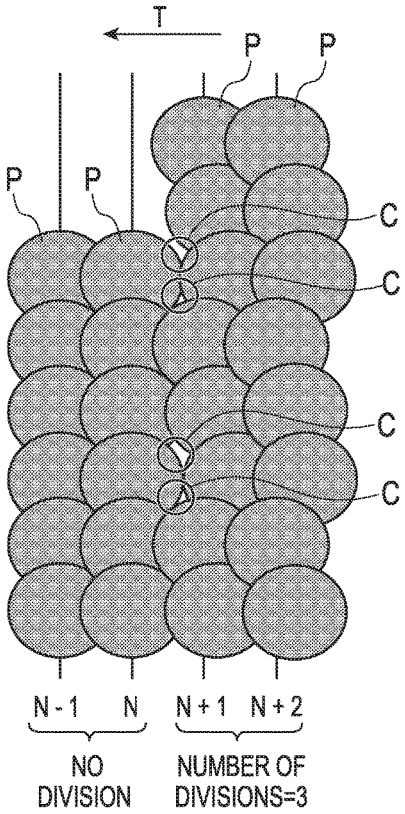
FIGS. 10A and 10B are diagrams illustrating examples of print states of when the number of the printing times is changed from one to three.
Figure 10B:
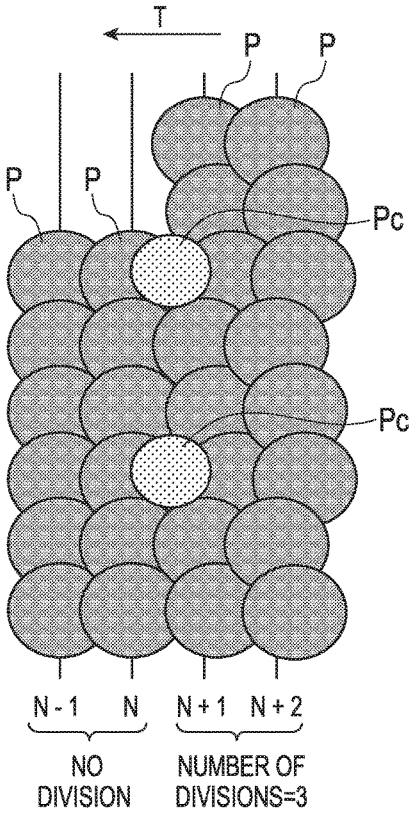

FIGS. 10A and 10B are diagrams illustrating examples of print states of when the number of the printing times is changed from one to three.

Figure 11:
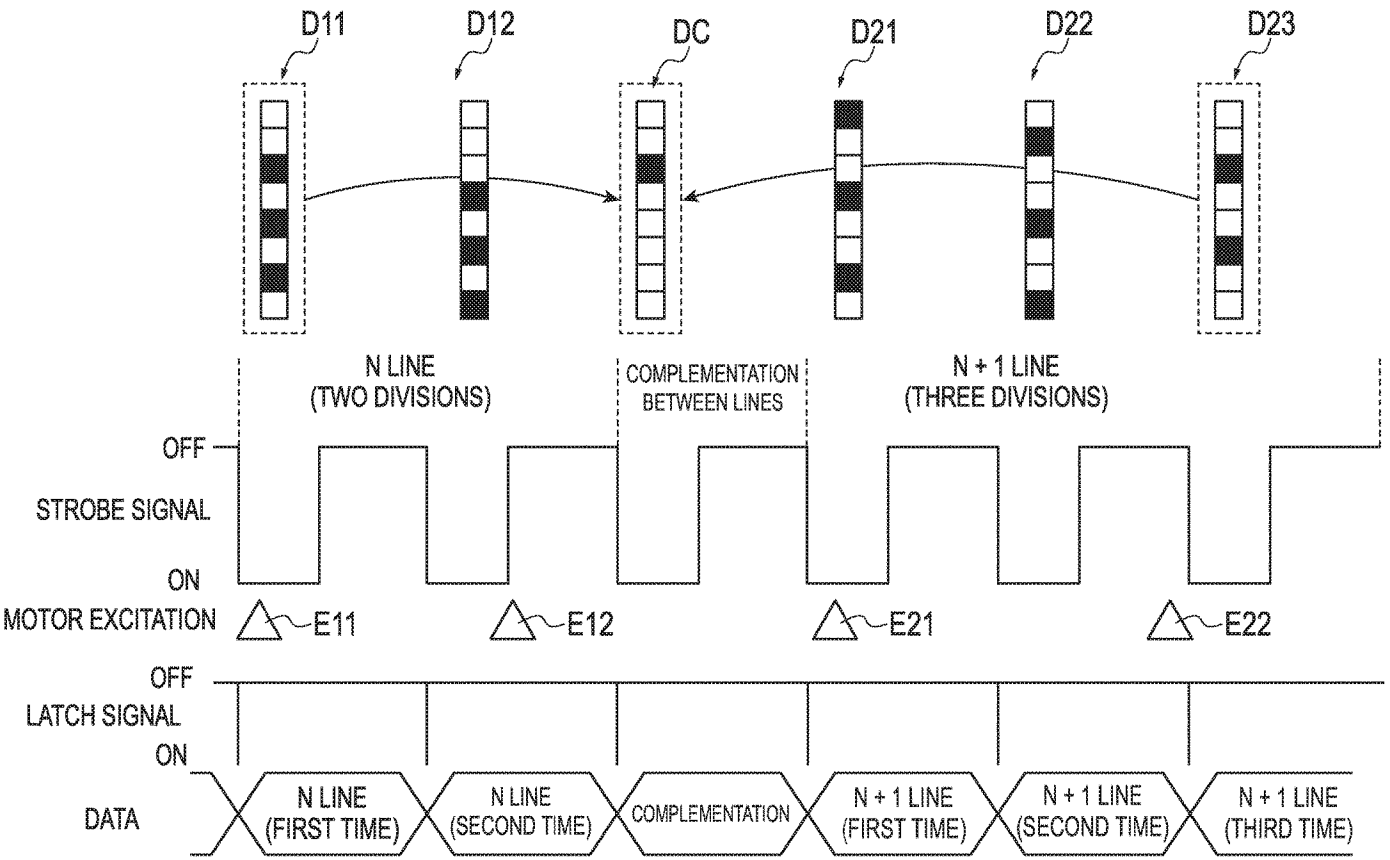
FIG. 11 is a diagram illustrating an example of a timing chart of when the number of the printing times is changed from two to three.

FIG. 11 is a diagram illustrating an example of a timing chart of when the number of the printing times is changed from two to three.

Figure 12A:
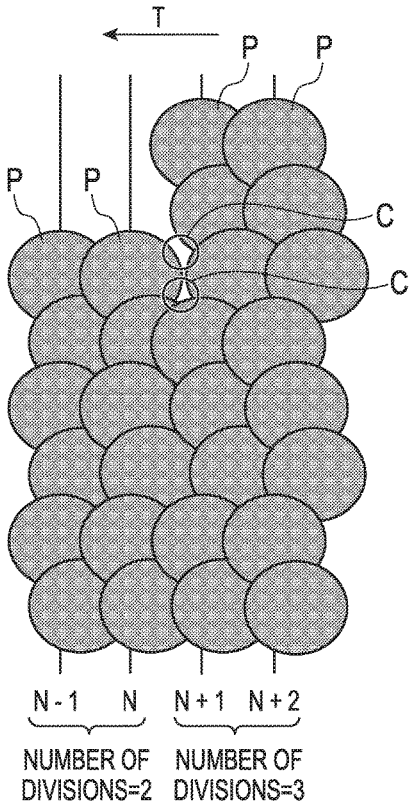
FIGS. 12A and 12B are diagrams illustrating examples of print states of when the number of the printing times is changed from two to three.
Figure 12B:
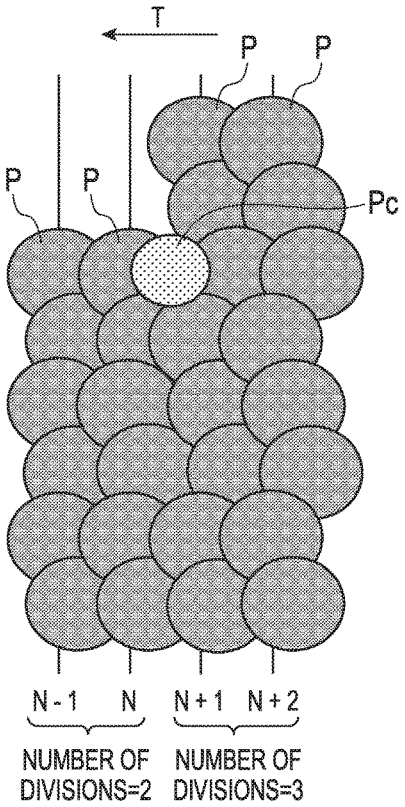

FIGS. 12A and 12B are diagrams illustrating examples of print states of when the number of the printing times is changed from two to three.

Figure 13:
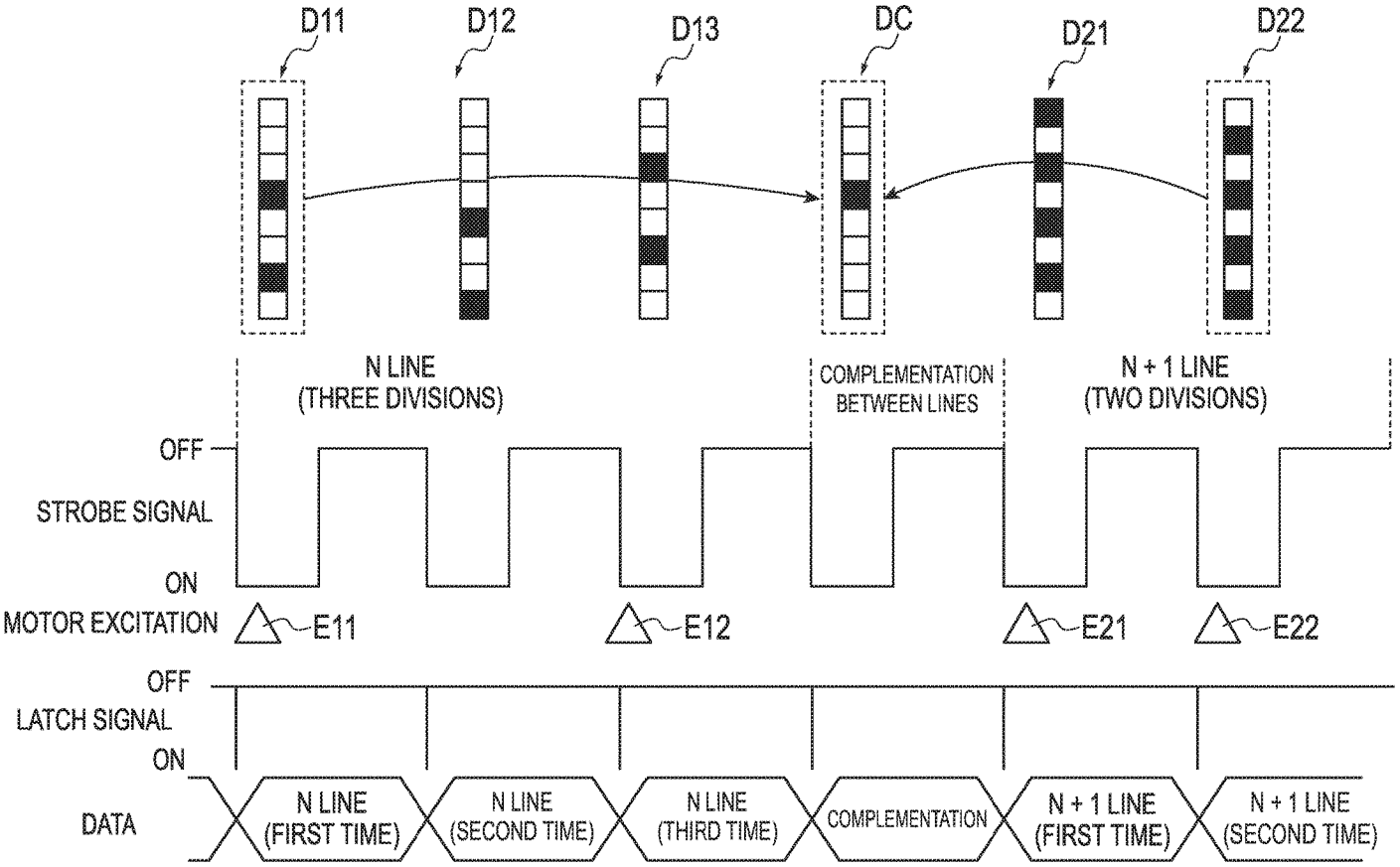
FIG. 13 is a diagram illustrating an example of a timing chart of when the number of the printing times is changed from three to two.

FIG. 13 is a diagram illustrating an example of a timing chart of when the number of the printing times is changed from three to two.

Figure 14A:
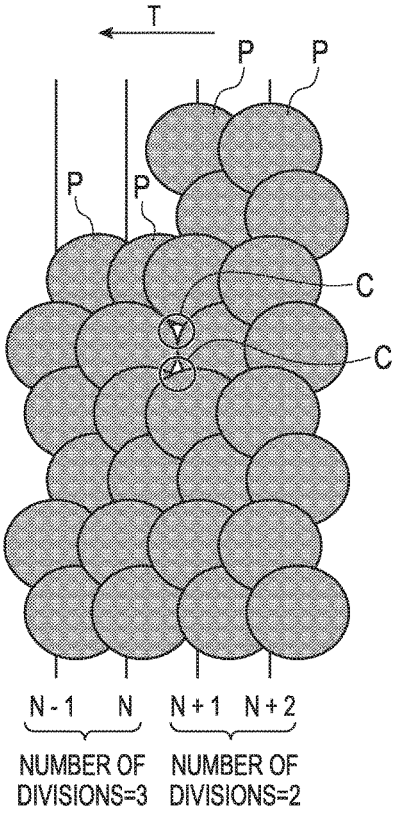
FIGS. 14A and 14B are diagrams illustrating examples of print states of when the number of the printing times is changed from three to two.
Figure 14B:
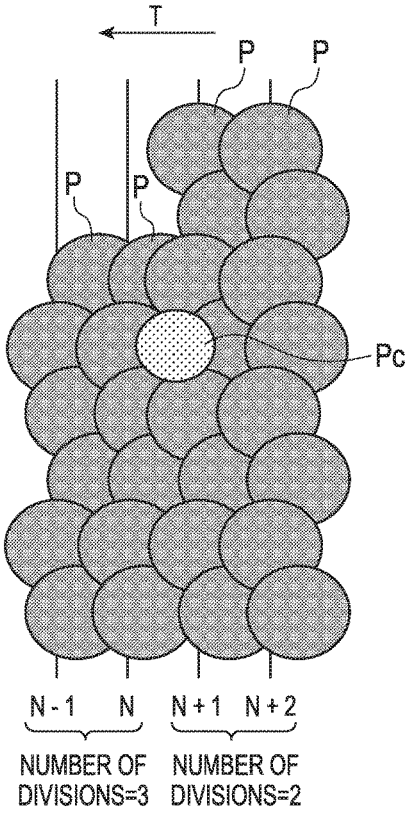

FIGS. 14A and 14B are diagrams illustrating examples of print states of when the number of the printing times is changed from three to two.

Note that FIGS. 10A, 12A and 14A illustrate the print state where no complementary printing is performed, respectively, and FIGS. 10B, 12B, and 14B illustrate the print state where the complementary printing is performed, respectively.

The arrows T illustrated in FIGS. 10A and 10B, 12A and 12B, and 14A and 14B indicate the conveying direction of the medium to be printed M.

In FIGS. 8A and 8B, the example in which the complementary printing is performed when the number of the printing times is changed from one to two has been described. However, the pattern of the change of the number of the printing times to perform the complementary printing is not limited only to the case where the number of the printing times is changed from one to two.

As illustrated in FIG. 9 to FIGS. 14A and 14B, the printing device 1 may perform the complementary printing when the number of the printing times is changed from one to three, may perform the complementary printing when the number of the printing times is changed from two to three, and may perform the complementary printing when the number of the printing times is changed from three to two.

As illustrated in FIG. 9, when the number of the printing times is changed from one to three, the printing device 1 may generate the complementary data DC on the basis of the print data D1 of the current print line (N line), and print data D23 of third printing, of the print data of the next print line.

FIG. 9 illustrates an example in which the complementary data DC (00100100) is generated by taking a logical product of the print data D1 (00111111) and the print data D23 (00100100).

In this case as well, as illustrated in FIGS. 10A and 10B, the complementary printing based on the complementary data is performed at the position where the gap C occurs between the print dots P, and the print dot Pc is printed. Therefore, variable division printing without missing print can be performed.

As illustrated in FIG. 11, when the number of the printing times is changed from two to three, the printing device 1 may generate the complementary data DC on the basis of the print data D11 of the first printing, of the print data of the current print line (N line), and the print data D23 of the third (last) printing, of the print data of the next print line.

FIG. 11 illustrates an example in which the complement data DC (00100000) is generated by taking a logical product of the print data D11 (00101010) and the print data D23 (00100100).

In this case as well, as illustrated in FIGS. 12A and 12B, the complementary printing based on the complementary data is performed at the position where the gap C occurs between the print dots P, and the print dot Pc is printed. Therefore, variable division printing without missing print can be performed.

Note that the printing device 1 may generate the complementary data DC from the print data D11 of the first printing of the print data of the current print line (N line), and the print data D23 corresponding to the printing performed after the switching of excitation, of the print data of the next print line (N+1 line).

As illustrated in FIG. 13, when the number of the printing times is changed from three to two, the printing device 1 may generate the complementary data DC on the basis of the print data D11 of the first printing, of the print data of the current print line (N line), and the print data D22 of the second printing, of the print data of the next print line.

FIG. 13 illustrates an example in which the complement data DC (00010000) is generated by taking a logical product of the print data D11 (00010010) and the print data D22 (01010101).

In this case as well, as illustrated in FIGS. 14A and 14B, the complementary printing based on the complementary data is performed at the position where the gap C occurs between the print dots P, and the print dot Pc is printed. Therefore, variable division printing without missing print can be performed.

The above-described embodiment provides the specific examples to facilitate understanding of the disclosure, and the present disclosure is not limited to these examples.

Various modifications and changes can be made to the printing device, the method of controlling a printing device, and the program without departing from the scope of the claims.

In the above-described embodiment, the printing device 1 including the input unit 3 and the display unit 4 has been exemplified. However, the printing device may be a printing device that does not include at least one of the input unit 3 and the display unit 4. The printing device may be a printing device that receives print data from a separately arranged computer.

In the above-described embodiment, the complementary data has been generated from the print data of the first printing of the first print line and the print data of the last printing of the second print line, of the print data of the first print line and the print data of the second print line, the first and second print lines being adjacent to each other along the conveying direction. However, the complementary data may be generated from other data.

For example, the complementary data may be generated from the print data of printing before the second switching of excitation of the first print line and the print data of printing after the second switching of excitation of the second print line.

What is claimed is:

1. A printing device, comprising:

a print head configured to print a plurality of print lines on a medium to be printed, the medium being conveyed in a conveying direction; and a processor configured to control the print head, wherein the processor is configured to:

control the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, the second print line being adjacent to the first print line along the conveying direction, control the print head to perform, after printing the first print line before printing the second print line, complementary printing that complements missing print estimated to occur between the first print line and the second print line in a case where a number of the printing times in the first print line and a number of the printing times in the second print line are set to different values from each other, and a number of the printing times in the second print line is set to two or more.

2. The printing device according to claim 1, wherein the processor is configured to:

generate complementary data to perform the complementary printing, on the basis of first print data for printing the first print line and second print data for the second print line in a case where the numbers of the printing times in the first print line and the second print line are different values from each other; and control the print head to perform the complementary printing on the basis of the complementary data.

3. The printing device according to claim 1, wherein, the processor is configured to control the print head to divide corresponding print line into a plurality of divided print lines by the number of the printing times in a case where the number of the printing times is two or more and to print each of the plurality of divided print lines by time division.

4. The printing device according to claim 1, wherein, the processor is configured to control the print head not to perform the complementary printing in a case where the number of the printing times in the second print line is once.

5. The printing device according to claim 1, comprising a conveyance motor configured to convey the medium in the conveying direction by rotation operation due to performing switching of excitation, wherein the processor is configured to control the print head to perform the complementary printing in a case where the number of the printing times in the second print line is two or more and the printing of the plurality of times by time division is divided and performed before and after switching of excitation of the conveyance motor.

6. The printing device according to claim 5, wherein the processor is configured to generate the complementary data from the print data for printing the first print line, and print data corresponding to the printing performed after the switching of excitation, in the printing of the plurality of times by time division, of the print data for printing the second print line.

7. The printing device according to claim 5, wherein, the processor is configured to generate the complementary data from print data corresponding to printing that is first performed, in the printing of the plurality of times by time division, of the print data for printing the first print line, and print data corresponding to the printing performed after the switching of excitation, in the printing of the plurality of times by time division, of the print data for printing the second print line, in a case where the number of the printing times in the first print line is two or more.

8. The printing device according to claim 5, wherein, the processor is configured to generate the complementary data from print data corresponding to printing that is first performed, in the printing of the plurality of times by time division, of the print data for printing the first print line, and print data corresponding to printing that is lastly performed, in the printing of the plurality of times by time division, of the print data for printing the second print line in a case where the number of the printing times in the first print line is two or more.

9. The printing device according to claim 8, wherein the processor is configured to generate the complementary data according to a logical product of the print data corresponding to printing that is first performed, in the printing of the plurality of times by time division, of the print data for printing the first print line, and the print data corresponding to printing that is lastly performed, in the printing of the plurality of times by time division, of the print data for printing the second print line.

10. A method of controlling a printing device, wherein the printing device comprises a print head configured to print a plurality of print lines on a medium to be printed, the medium being conveyed in a conveying direction, and the method comprises:

controlling the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, the second print line being adjacent to the first print line along the conveying direction, controlling the print head to perform, after printing the first print line before printing the second print line, complementary printing that complements missing print estimated to occur between the first print line and the second print line in a case where a number of the printing times in the first print line and a number of the printing times in the second print line are set to different values from each other, and a number of the printing times in the second print line is set to two or more.

11. The method of controlling the printing device according to claim 10, comprising:

generating complementary data to perform the complementary printing, on the basis of first print data for printing the first print line and second print data for the second print line in a case where the numbers of printing times in the first print line and the second print line are different from each other; and controlling the print head to perform the complementary printing on the basis of the complementary data.

12. The method of controlling the printing device according to claim 10, comprising:

controlling the print head not to perform the complementary printing in a case where the number of the printing times in the second print line is once.

13. The method of controlling the printing device according to claim 10, wherein the printing device comprises a conveyance motor configured to convey the medium in the conveying direction by rotation operation due to performing switching of excitation, and the method comprises:

controlling the print head to perform the complementary printing in a case where the number of the printing times in the second print line is two or more and the printing of the plurality of times by time division is divided and performed before and after switching of excitation of the conveyance motor.

14. The method of controlling the printing device according to claim 13, comprising:

generating the complementary data from the print data for printing the first print line, and print data corresponding to the printing performed after the switching of excitation, in the printing of the plurality of times by time division, of the print data for printing the second print line.

15. The method of controlling the printing device according to claim 13, comprising:

generating the complementary data from print data corresponding to printing that is first performed, in the printing of the plurality of times by time division, of the print data for printing the first print line, and print data corresponding to the printing performed after the switching of excitation, in the printing of the plurality of times by time division, of the print data for printing the second print line, in a case where the number of the printing times in the first print line is two or more.

16. The method of controlling the printing device according to claim 13, comprising:

generating the complementary data from print data corresponding to printing that is first performed, in the printing of the plurality of times by time division, of the print data for printing the first print line, and print data corresponding to printing that is lastly performed, in the printing of the plurality of times by time division, of the print data for printing the second print line in a case where the number of the printing times in the first print line is two or more.

17. The method of controlling the printing device according to claim 16, comprising:

generating the complementary data according to a logical product of the print data corresponding to printing that is first performed, in the printing of the plurality of times by time division, of the print data for printing the first print line, and the print data corresponding to printing that is lastly performed, in the printing of the plurality of times by time division, of the print data for printing the second print line.

18. A non-transitory computer-readable storage medium in which a control program of a printing device is stored, wherein the printing device comprises a print head configured to print a plurality of print lines on a medium to be printed, the medium being conveyed in a conveying direction, and the control program causes the printing device to:

control the print head to print each of the plurality of print lines by a number of printing times which is once or a plurality of times by time division according to print data for printing each of the plurality of print lines; and in printing of a first print line and a second print line to be printed after the first print line of the plurality of print lines by the print head, the second print line being adjacent to the first print line along the conveying direction, control the print head to perform, after printing the first print line before printing the second print line, complementary printing that complements missing print estimated to occur between the first print line and the second print line in a case where a number of the printing times in the first print line and a number of the printing times in the second print line are set to different values from each other, and a number of the printing times in the second print line is set to two or more.

* * * * *